US009291072B2

(12) United States Patent
Ranz

(10) Patent No.: US 9,291,072 B2
(45) Date of Patent: Mar. 22, 2016

(54) EXTERNALLY THREADED JOURNAL HOUSING

(71) Applicant: Andrew J. Ranz, Enfield, CT (US)

(72) Inventor: Andrew J. Ranz, Enfield, CT (US)

(73) Assignee: Dresser-Rand Company, Olean, NY (US)

( * ) Notice: Subject to any disclaimer, the term of this patent is extended or adjusted under 35 U.S.C. 154(b) by 794 days.

(21) Appl. No.: 13/632,765

(22) Filed: Oct. 1, 2012

(65) Prior Publication Data

US 2013/0089407 A1 Apr. 11, 2013

Related U.S. Application Data

(60) Provisional application No. 61/543,831, filed on Oct. 6, 2011.

(51) Int. Cl.

| | |
|---|---|
| ***F01D 25/16*** | (2006.01) |
| ***F04D 29/046*** | (2006.01) |
| ***F04D 29/056*** | (2006.01) |
| ***F04D 29/62*** | (2006.01) |
| ***F04D 29/64*** | (2006.01) |

(52) U.S. Cl.

CPC ..... *F01D 25/162* (2013.01); *F04D 29/0462* (2013.01); *F04D 29/056* (2013.01); *F04D 29/624* (2013.01); *F04D 29/644* (2013.01)

(58) Field of Classification Search

CPC ... F01D 25/162; F01D 25/16; F04D 29/0462; F04D 29/056; F04D 29/0563; F16C 43/04; F16C 35/045

See application file for complete search history.

(56) References Cited

U.S. PATENT DOCUMENTS

| | | | | | |
|---|---|---|---|---|---|
| 3,765,708 | A | * | 10/1973 | Pease et al. | 285/382.2 |
| 3,994,541 | A | * | 11/1976 | Geary et al. | 384/117 |
| 4,880,320 | A | * | 11/1989 | Haines et al. | 384/215 |
| 5,409,350 | A | * | 4/1995 | Mitchell | 415/111 |
| 5,482,380 | A | * | 1/1996 | Corratti et al. | 384/311 |
| 6,705,965 | B2 | * | 3/2004 | Sullivan | 475/230 |

* cited by examiner

*Primary Examiner* — Richard Edgar
*Assistant Examiner* — Juan G Flores
(74) *Attorney, Agent, or Firm* — Edmonds & Nolte, PC

(57) ABSTRACT

A journal housing including a series of housing threads defined on an outer radial surface. The series of housing threads may be adapted to threadably engage a series of casing threads defined on an inner radial surface of a casing. A shoulder may extend radially-outward from the outer radial surface, and the shoulder may be disposable axially-adjacent the casing and adapted to receive at least one first mechanical fastener.

16 Claims, 4 Drawing Sheets

EXTERNALLY THREADED JOURNAL HOUSING

The present application claims priority to U.S. Application No. 61/543,831 filed Oct. 6, 2011. The priority application is hereby incorporated by reference in its entirety into the present application.

BACKGROUND

Centrifugal compressors generally include a rotating shaft with radial journal bearings at each end to support the radial load of the shaft. Each journal bearing typically has an associated journal housing disposed radially-outward therefrom. The journal housing is secured to the compressor casing via a bolted flange, which thereby maintains the journal bearing in the desired location during normal compressor operation. A seal, such as a gas seal, is positioned inboard of the journal housing to prevent leakage of the pressurized process fluid, and a shear ring serves to constrain the gas seal in its place.

As improved compressors continue to output higher and higher pressures, components such as the bearing housing and compressor head are required to increase in size in order to keep the system robust enough to handle such increased pressures. The increased pressures and larger components, however, tend to cause problems in traditional compressors. For example, as the pressure increases, the shear ring and its associated annulus create high stress concentrations in the compressor head and/or journal housing. Overtime, these increased stresses may exceed the fatigue limits of the components, thus requiring early repair or replacement.

Moreover, as the shaft increases in length to accommodate the larger compressor components, the bearing span inevitably increases, and misalignment of the shaft and adverse rotordynamics may result, thereby rendering the compressor inefficient or entirely inoperable. Furthermore, as the journal housings increase in size to support the longer shaft, the available space for head piping to the gas seals is also reduced.

What is needed, therefore, is a practical approach for reducing or eliminating the aforementioned problems. Specifically, what is needed is an approach for decreasing internal stresses, decreasing the bearing span, and maintaining sufficient space for head piping.

SUMMARY

Embodiments of the disclosure may provide a journal housing. The journal housing may include a series of housing threads defined on an outer radial surface. The series of housing threads may be adapted to threadably engage a series of casing threads defined on an inner radial surface of a casing. A shoulder may extend radially-outward from the outer radial surface, and the shoulder may be disposable axially-adjacent the casing and adapted to receive at least one first mechanical fastener.

Embodiments of the disclosure may further provide a turbomachine. The turbomachine may include a journal bearing disposed radially-outward from a rotatable shaft, and the journal bearing may be configured to provide support to the rotatable shaft. A journal housing may be disposed radially-outward from the journal bearing and have a series of housing threads defined on an outer radial surface thereof. The turbomachine may further include a casing having a series of casing threads defined on an inner radial surface thereof. The series of housing threads may be adapted to threadably engage the series of casing threads. A seal may be disposed inboard of the journal housing. A spacer ring may interpose the journal housing and the seal, and the spacer ring may be adapted to maintain a predetermined distance between the journal housing and the seal.

Embodiments of the disclosure may further provide a method of operating a turbomachine. The method may include supporting a shaft with a journal bearing where the shaft is arranged for rotation within a casing. The method may also include supporting the journal bearing within a journal housing disposed radially-outward from the journal bearing. The journal housing may have a series of housing threads defined on an outer radial surface thereof, and the series of housing threads may be threadably engageable with a series of casing threads defined on an inner radial surface of the casing.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
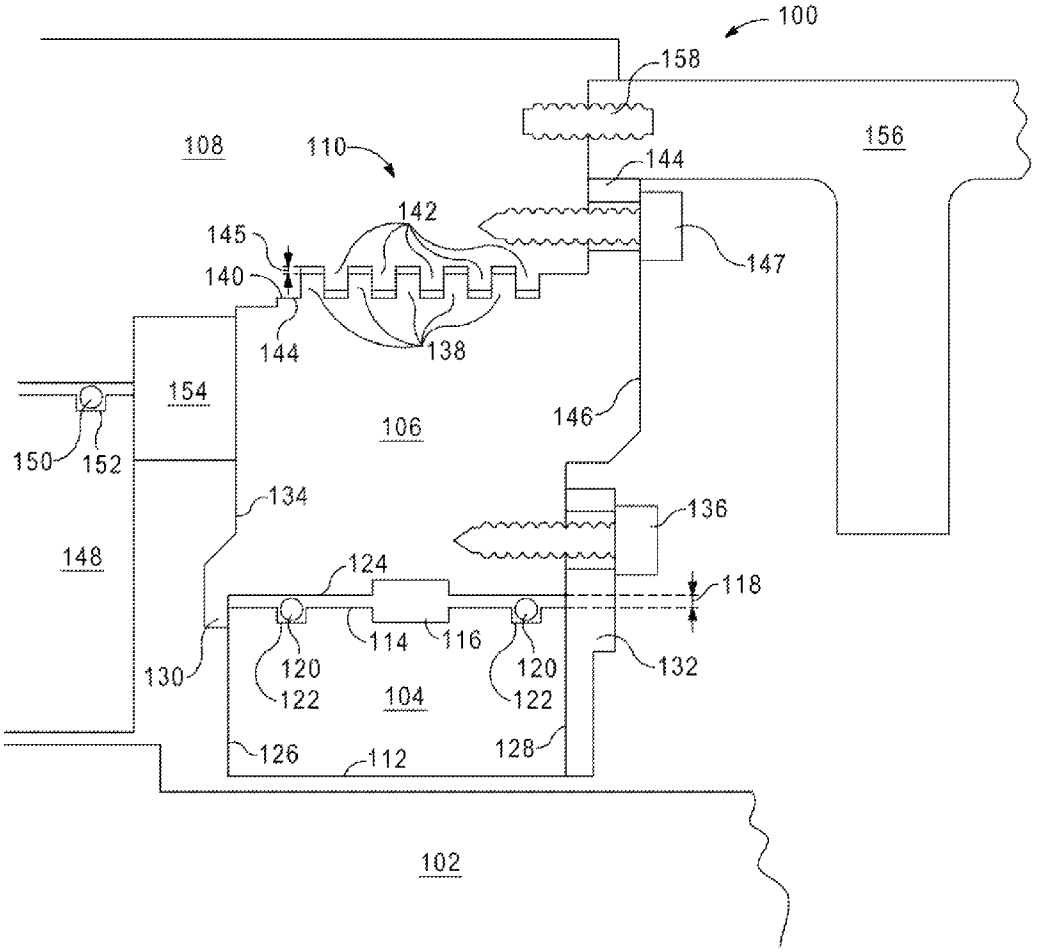
FIG. 1 illustrates a partial cross-sectional view of a section of a turbomachine, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a partial cross-sectional view of a section of an exemplary turbomachine 100, according to one or more embodiments described. The turbomachine 100 may be a turbine, such as a steam turbine or a gas turbine, pump, compressor, such as a centrifugal compressor or a reciprocating compressor, or any other piece of rotating equipment. In at least one embodiment, the turbomachine 100 may be a high pressure acid gas ("HPAG") compressor adapted to compress an acidic gas mixture, which for example, may contain hydrogen sulfide or similar acidic elements that may be considered contaminants.

The turbomachine 100 may include a rotatable shaft 102 extending axially therethrough. The shaft 102 may extend through and be supported by one or more annular journal bearings 104 positioned near each end of the shaft 102. In the exemplary embodiment depicted in FIG. 1, the journal bearing 104 is positioned on the right-hand side of the shaft 102 such that the shaft 102 extends to the left where it is equally supported by at least a second journal bearing that is not shown. The journal bearing 104 may be coupled to or otherwise supported by a journal housing 106 disposed radially-outward therefrom. The journal housing 106, in turn, may be coupled to or otherwise supported by a pressure-containing housing or casing 108 disposed radially-outward therefrom. The casing 108 may engage the journal housing 106 via a threaded connection 110, as will be described in greater detail below. In at least one embodiment, the casing 108 may include or at least form part of a compressor head.

The journal bearing 104 may have an inner radial surface 112 disposed proximate the shaft 102 and an outer radial surface 114 disposed proximate an inner radial surface 124 of the journal housing 106. In one embodiment, the journal bearing 104 may be a tilt pad journal bearing having a plurality of pads (not shown) disposed about the inner radial surface 112 and adapted to contact and support the shaft 102. The pads may be able to move or tilt on a pivot to achieve pad-to-shaft 102 alignment during normal operation of the turbomachine 100. An oil reservoir 116 may be defined generally between the journal bearing 104 and the journal housing 106. The oil reservoir 116 may be configured to supply lubricating oil to the inner radial surface 112 of the journal bearing 104, i.e., the pads, to reduce the friction and associated heat generated between the pads and the rotating shaft 102 as a result of the rotating engagement between the components.

In at least one embodiment, the journal bearing 104 may be a damper bearing that defines a gap 118 between the journal bearing 104 and the journal housing 106. To prevent pressurized process fluid from leaking through the gap 118, one or more O-rings 120 (two are shown) may be disposed within corresponding annuli 122 defined in the outer radial surface 114 of the journal bearing 104. In other embodiments, the annuli 122 may be defined in the inner radial surface 124 of the journal housing 106 without departing from the scope of the disclosure. In yet other embodiments, the journal bearing 104 may omit the gap 118, such as is described with reference to FIG. 2 below.

The journal bearing 104 may have a first axial end 126 and a second axial end 128. The journal bearing 104 may be constrained in a concentric position with the journal housing 106 by a first journal housing shoulder 130 arranged proximate the first axial end 126 and an annular plate 132 arranged proximate the second axial end 128. The first journal housing shoulder 130 may extend axially-outward from a first axial end 134 of the journal housing 106 and radially-inward from the inner radial surface 124. As illustrated, the first journal housing shoulder 130 may be disposed axially adjacent and in biasing engagement with the first axial end 126 of the journal bearing 104. The plate 132 may be disposed axially-adjacent the second axial end 128 of the journal bearing 104. One or more mechanical fasteners 136, such as bolts or screws, may couple the plate 132 to the journal housing 106. For example, at least two anti-rotation retaining bolts may secure the plate 132 to the journal housing 106.

The journal housing 106 may be threadably engaged or otherwise secured with/to the casing 108 at the threaded connection 110. As shown, the threaded connection 110 includes a series of housing threads 138 defined on an outer radial surface 140 of the journal housing 106 and a series of corresponding casing threads 142 defined on an inner radial surface 144 of the casing 108. The housing threads 138 may be external threads, and the casing threads 142 may be internal threads. The corresponding threads 138, 142 may be buttress threads having substantially vertical load-bearing faces adapted to withstand an axial thrust force. In one embodiment, the buttress threads 138, 142 may be square buttress threads having substantially vertical non load-bearing faces. In other embodiments, the buttress threads 138 may be slanted buttress threads having angled non load-bearing faces.

When properly engaged, a gap 145 may be defined between the vertical extents of each thread 138, 142 and the adjacent components 108, 106. The gap 145 may be defined via one or more pilot fit engagements between the journal housing 106 and the casing 108 on opposing axial ends of said components 106, 108. Although five housing threads 138 and five casing threads 142 are shown, it will be appreciated that the number of threads 138, 142 may vary as more or less, depending on factors such as anticipated axial thrusts, machining costs, weight limits, etc.

A second journal housing shoulder 144 may extend radially-outward from the outer radial surface 140 proximate a second axial end 146 of the journal housing 106. The second journal housing shoulder 144 may be disposed axially-adjacent and configured to engage the casing 108. One or more mechanical fasteners 147, such as bolts or screws, may couple or otherwise mechanically-attach the journal housing shoulder 144 to the casing 108. In other embodiments, the mechanical fastener 147 is an anti-rotation set screw configured to prevent the journal housing 106 from unthreading from its threaded engagement with the casing 108.

One or more seals 148 (one is shown) may be arranged inboard of the journal housing 106 and journal bearing 104. The seal 148 may be a dry gas seal, a labyrinth seal, or any other known seal adapted to prevent high-pressure process fluid leakage. In the event that the seal 148 is a gas seal, head piping (not shown) may be fluidly coupled thereto to supply seal gas. One or more O-rings 150 may be disposed in an annulus 152 between the seal 148 and the casing 108 to help prevent the process fluid from leaking therebetween.

A spacer ring 154 may be disposed between the seal 148 and the journal housing 106. The spacer ring 154 may be used to maintain a predetermined distance between the seal 148 and the journal housing 106 during operation of the turbomachine 100.

In at least one embodiment, a thrust housing 156 may be disposed proximate the second axial end 146 of the journal housing 106. One or more mechanical fasteners 158, such as screws or bolts, may couple the thrust housing 156 to the casing 108. For example, eight circumferentially spaced anti-rotation retaining bolts 158 may secure the thrust housing 156 to the casing 108. As shown, the mechanical fasteners 158 may be disposed radially-outward from the mechanical fasteners 147 coupling the journal housing 106 to the casing 108.

As can be appreciated, the threaded connection 110 between the journal housing 106 and the casing 108 may serve to reduce the axial length of the journal housing 106 since the axial loads may be borne over the entire axial length of the threaded connection 110, rather than being absorbed at a single location. Consequently, the bearing span of the turbomachine 100 may be reduced, thereby reducing its overall size and weight. In at least one embodiment, the bearing span may be reduced by about four inches, but may be reduced by greater lengths depending on the type of turbomachine 100. The threaded connection 110 may also serve to eliminate the traditional bolted flange connection between the journal housing 106 and casing 108. This may free up space for head piping (not shown) to gas seals 148 inboard of the journal housing 106.

To assemble the components of the turbomachine 100 described above, the journal housing 106 is threaded into the casing 108 at the threaded connection 110. Once the journal housing 106 has been threaded into place, as seen in FIG. 1, a distance between the journal housing 106 and the seal 148 may be measured in order to define an axial width for the spacer ring 154. In one embodiment, the distance may be measured using an axial bore (not shown) defined through the journal housing 106 that provides access to the area to be measured. The spacer ring 154 may then be manufactured to have an axial width that corresponds to the measured distance. To ensure close tolerances, the spacer ring 154 may be machined or ground to the exact measurement. Accordingly, the axial width of the spacer ring 154 may be equivalent to the measured distance such that a tight engagement with the seal 148 and the journal housing 106 results on either side of the spacer ring 154. However, in at least one embodiment, a small gap (not shown) may exist between the spacer ring 154 and the seal 148 and/or the journal housing 106. For example, the gap between the spacer ring 154 and the seal 148 may be between about 0.001 inches and about 0.006 inches.

After the measurement and manufacturing of the spacer ring 154, the journal housing 106 may be threadably disengaged so that the spacer ring 154 may be positioned axially-adjacent the seal 148. When the spacer ring 154 is installed, the journal housing 106 may again be threaded to the casing 108. The one or more mechanical fasteners 147 may be engaged to prevent the journal housing 106 from threadably disengaging or otherwise reverse rotating from the casing 108.

The journal bearing 104 may be positioned radially-inward from and concentric with the journal housing 106. In at least one embodiment, the outer diameter (outer radial surface 114) of the journal bearing 104 may be equivalent to or slightly less than the inner diameter (inner radial surface 124) of the journal housing 106 such that the journal bearing 104 may be inserted into place in a line-to-line or close tolerance fit. In another embodiment, the outer diameter of the journal bearing 104 may be equivalent to or slightly greater than the inner diameter of the journal housing 106. When this occurs, the journal housing 106 may be heat shrunk onto the journal bearing 104. For example, the journal bearing 104 may be chilled so that it may contract and/or the journal housing 106 may be heated so that it may expand. The temporary expansion/contraction may allow the journal bearing 104 to be inserted into place.

Figure 2:
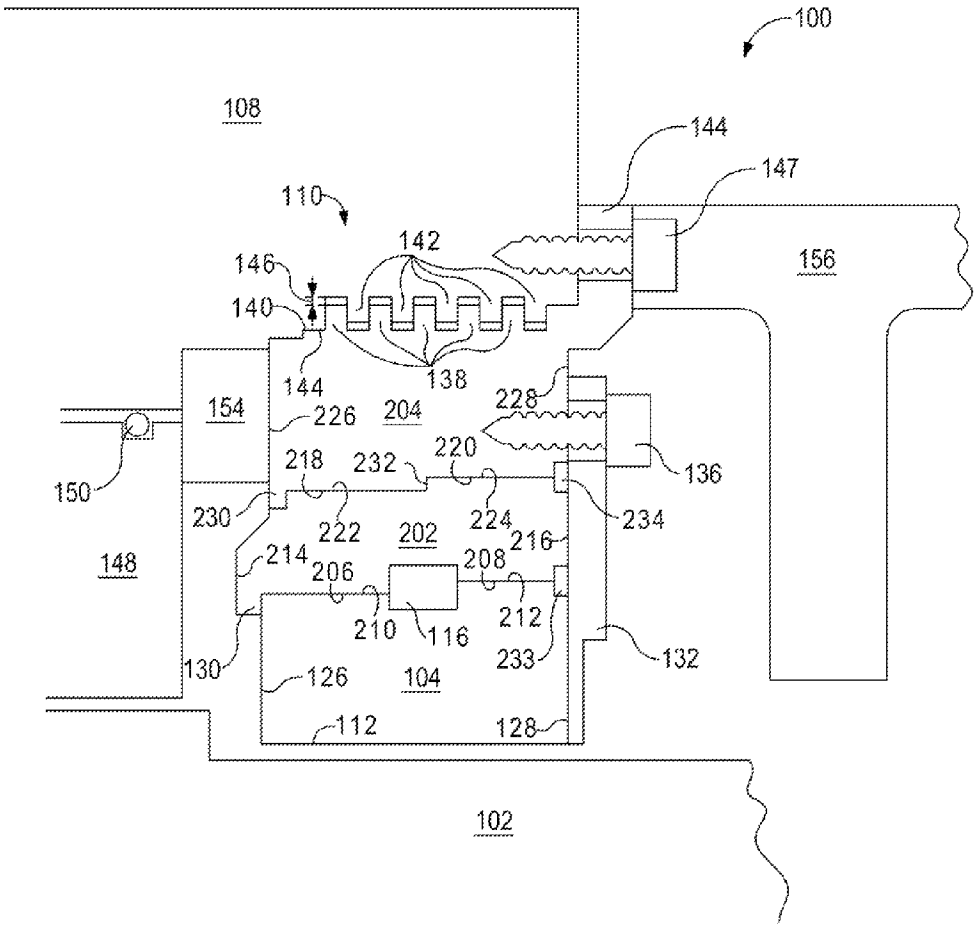
FIG. 2 illustrates another partial cross-sectional view of the section of the turbomachine depicted in FIG. 1, according to one or more embodiments.

FIG. 2 illustrates another partial cross-sectional view of the exemplary turbomachine 100 depicted in FIG. 1, according to one or more embodiments described. In the illustrated embodiment, the journal housing 106 may be generally split to include an inner journal housing 202 and an outer journal housing 204. The inner and outer journal housings 202, 204 may be generally annular and concentric with one another. The inner journal housing 202 may have offset inner radial surfaces 210, 212 corresponding to first and second outer radial surfaces 206, 208 of the journal bearing 104. The first inner radial surface 210, positioned proximate a first axial end 214 of the inner journal housing 202, may be disposed radially-inward from the second inner radial surface 212, which may be positioned proximate a second axial end 216 of the inner journal housing 202. In another embodiment, the surfaces 210, 212 may have substantially the same radius.

The inner journal housing 202 may also include offset outer radial surfaces 222, 224. The first outer radial surface 222, positioned proximate the first axial end 214, may be disposed radially-inward from the second outer radial surface 224, which may be positioned proximate the second axial end 216. In another embodiment, the surfaces 222, 224 may have substantially the same radius. The outer journal housing 204 may have offset inner radial surfaces 218, 220 corresponding to the first and second outer radial surfaces 222, 224 of the inner journal housing 202. The first inner radial surface 218, positioned proximate a first axial end 226, may be disposed radially-inward from the second inner radial surface 220, which may be positioned proximate a second axial end 228 of the outer journal housing 204. In another embodiment, the surfaces 218, 220 may have substantially the same radius.

The journal bearing 104 may be maintained in a concentric position with the inner journal housing 202 by the first journal housing shoulder 130, which may now be referred to as the inner journal housing shoulder 130, adjacent the first axial end 126 and the annular plate 132 adjacent the second axial end 128. The outer journal housing 204 may include a first outer journal housing shoulder 230 extending radially-inward from the inner radial surface 222 and a second outer journal housing shoulder 232 defined by the offset inner radial surfaces 222, 224 of the outer journal housing 204. The first and second journal housing shoulders 230, 232 and the plate 132 may cooperate to maintain the inner journal housing 202 in a concentric position with the outer journal housing 204. The mechanical fastener(s) 136 may couple the plate 132 to the outer journal housing 204.

One or more pins or dowels 233 (one is shown) may be disposed in correspondingly aligned bores defined in the journal bearing 104 and the inner journal housing 202. The dowel(s) 233 may prevent the journal bearing 104 from rotating with respect to the inner journal housing 202 during turbomachine 100 operation. Likewise, one or more pins or dowels (one is shown) 234 may be disposed in correspondingly aligned bores defined in the inner journal housing 202 and the outer journal housing 204. The dowel(s) 234 may prevent the inner journal housing 202 from rotating with respect to the outer journal housing 204.

In at least one embodiment, the mechanical fasteners 158 (see FIG. 1) may be positioned at about the same radial distance from the shaft 102 as the mechanical fasteners 147, but circumferentially offset from the mechanical fasteners 147 so as to not interfere therewith. By placing the mechanical fasteners 158 at roughly the same radial distance from the shaft 102 as the mechanical fasteners 147, the available space for head piping is further increased.

Figure 3:
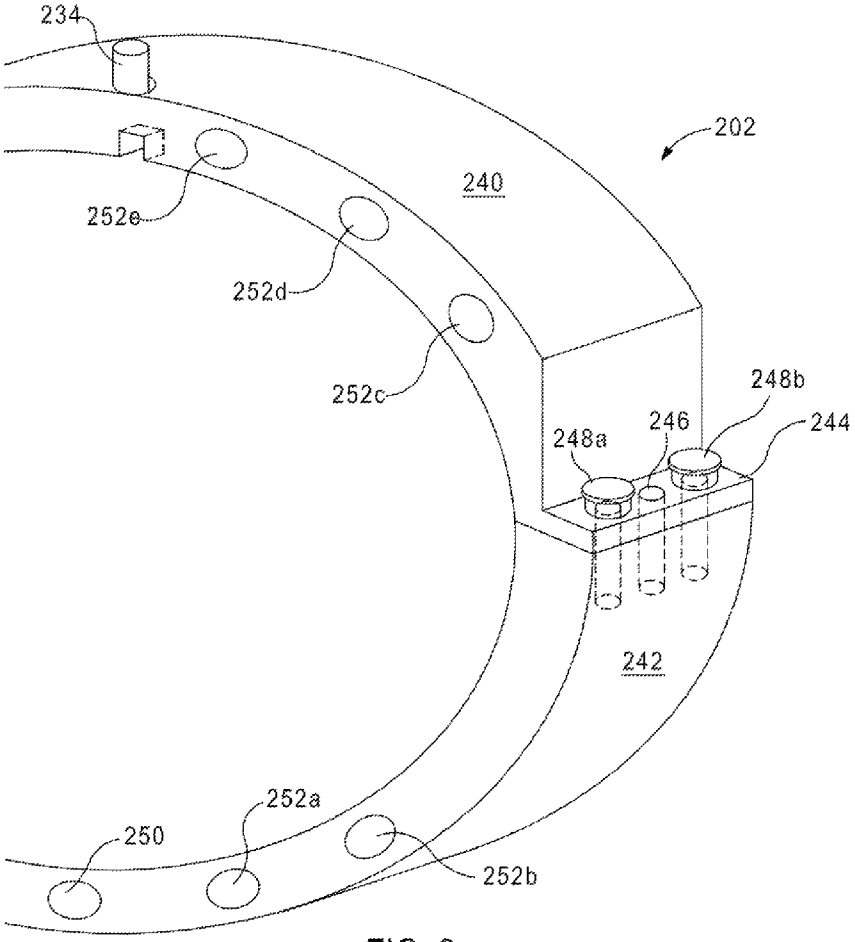
FIG. 3 illustrates a perspective view of the inner journal housing depicted in FIG. 2, according to one or more embodiments.

FIG. 3 illustrates a perspective view of the inner journal housing 202 generally depicted in FIG. 2, according to one or more embodiments described. The inner journal housing 202 may be split into first and second inner journal housing sections 240, 242, e.g., upper and lower halves. It will be appreciated that the first and second sections 240, 242 may be coupled together to form a full annulus by any known method or process. In one embodiment, one of the first or second inner journal housing sections 240, 242 may define a shoulder 244 proximate the interface between the corresponding sections 240, 242. As shown in the illustrated embodiment, only the first inner journal housing section 240 defines a shoulder 244; however, other embodiments are contemplated where the second inner journal housing section 242 defines the shoulder 244.

The shoulder 244 may facilitate the coupling of the first and second inner journal housing sections 240, 242. One or more pins or dowels 246 (one is shown) may be disposed in aligned bores defined in the first and second inner journal housing sections 240, 242 to prevent relative motion therebetween. One or more mechanical fasteners 248*a*, 248*b* (two are shown) may extend through the shoulder 244 of the first inner journal housing section 240 and into the second inner journal housing section 242 and secure the two sections 240, 242 together. The mechanical fasteners 248*a*, 248*b* may be screws, such as cap screws, bolts, or any other known device for mechanically-coupling two components together. Although not shown, the opposite interface between the first and second inner journal housing sections 240, 242 may be arranged in the same manner as described above, or it may be arranged differently.

One or more oil supply bores 250 may be defined in the second inner journal housing section 242. The oil supply bore 250 may supply the lubricating oil to/from the oil reservoir 116 (see FIG. 2) disposed between the journal bearing 104 and the inner journal housing 202. A plurality of vent and drain bores 252*a-e* may also be disposed axially through and circumferentially around the first and second inner journal housing sections 240, 242. The vent and drain bores 252*a-e* may be adapted to flow oil and/or air therethrough to the outboard side, i.e., the second axial side 216, of the inner journal housing 202.

Referring to FIGS. 2 and 3, to assemble the described components of the turbomachine 100, the outer journal housing 204 may be threadably engaged with the casing 108 at the threaded connection 110. Once the outer journal housing 204 has been threaded into place, as seen in FIG. 2, the distance between the outer journal housing 204 and the seal 148 may be measured to determine the required axial width of the spacer ring 154. An axial bore (not shown) through the outer journal housing 204 may provide access to the area to be measured. The spacer ring 154 may then be formed corresponding to the measured distance between the outer journal housing 204 and the seal 148.

After the measurement and/or the forming of the spacer ring 154, the outer journal housing 204 may be threadably disengaged so that the spacer ring 154 may be positioned proximate the seal 148. When the spacer ring 154 is in place, the outer journal housing 204 may be again threadably engaged with the casing 108. The one or more mechanical fasteners 147 may be inserted to prevent the outer journal housing 204 from threadably disengaging with the casing 108.

The first and second inner journal housing sections 240, 242 (FIG. 3) may be placed around the circumference of the journal bearing 104 and secured thereto with the one or more mechanical fasteners 248*a*, 248*b*. In at least one embodiment, the outer diameter of the journal bearing 104 may be equivalent to or slightly greater than the inner diameter of the inner journal housing 202. As the fasteners 248*a*, 248*b* are tightened, the first and second inner journal housing sections 240,242 may be tightened around the journal bearing 104, i.e., a light press fit.

Once secured around the journal bearing 104, the inner journal housing 202 may be positioned radially-inward from and concentric with the outer journal housing 204. This may be accomplished via a line-to-line fit or with the heat shrinking technique generally described above.

Figure 4:
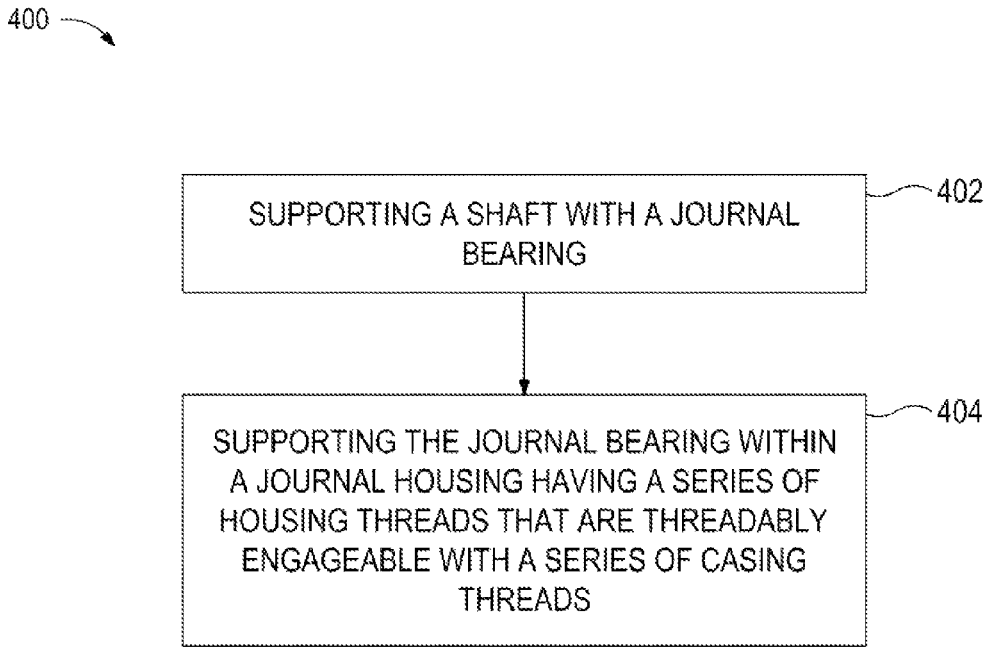
FIG. 4 illustrates a flowchart of a method for operating a turbomachine, according to one or more embodiments.

FIG. 4 illustrates a flowchart of a method 400 for operating a turbomachine, according to one or more embodiments described. A shaft may be supported with a journal bearing, as at 402. The shaft may be arranged for rotation within a casing. The journal bearing may be supported within a journal housing, as at 404. The journal housing may have a series of housing threads defined on an outer radial surface. The series of housing threads may be adapted to threadably engage a series of casing threads defined on an inner radial surface of a casing.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A journal housing, comprising:

a series of housing threads defined on an outer radial surface, the series of housing threads being adapted to threadably engage a series of casing threads defined on an inner radial surface of a casing;

a shoulder extending radially-outward from the outer radial surface, the shoulder being disposable axially-adjacent the casing and adapted to receive at least one first mechanical fastener;

an inner journal housing comprising a first inner journal housing section and a second inner journal housing section, the first and second journal housing sections being configured to form a complete annulus when coupled together, and the first inner journal housing section including a shoulder proximate an interface between the first and second inner journal housing sections; and an outer journal housing disposed radially-outward from and concentric with the inner journal housing, wherein the outer journal housing defines the series of housing threads.

2. The journal housing of claim 1, wherein the series of housing threads comprises buttress threads.

3. The journal housing of claim 2, wherein the buttress threads comprise square buttress threads.

4. The journal housing of claim 1, wherein the series of housing threads comprises external threads and the series of casing threads comprises internal threads.

5. The journal housing of claim 1, wherein the at least one first mechanical fastener prevents the journal housing from threadably disengaging with the casing.

6. The journal housing of claim 1, wherein the inner journal housing comprises first and second outer surfaces that are radially offset from one another.

7. The journal housing of claim 1, wherein one or more second mechanical fasteners extend through the shoulder of the first inner journal housing section and into the second inner journal housing section to secure the first and second inner journal housing sections together.

8. A turbomachine, comprising:

a journal bearing disposed radially-outward from a rotatable shaft, the journal bearing being configured to provide support to the rotatable shaft;

a journal housing disposed radially-outward from the journal bearing and having a series of housing threads defined on an outer radial surface thereof, the journal housing further comprising:

an inner journal housing comprising a first inner journal housing section and a second inner journal housing section, the first and second journal housing sections being configured to form a complete annulus when coupled together, and the first inner journal housing section including a shoulder proximate an interface between the first and second inner journal housing sections; and an outer journal housing disposed radially-outward from and concentric with the inner journal housing, wherein the outer journal housing defines the series of housing threads;

a casing having a series of casing threads defined on an inner radial surface thereof, the series of housing threads adapted to threadably engage the series of casing threads;

a seal disposed inboard of the journal housing; and a spacer ring interposing the journal housing and the seal, the spacer ring being adapted to maintain a predetermined distance between the journal housing and the seal.

9. The turbomachine of claim 8, further comprising a plate secured to the journal housing and adapted to maintain the journal bearing in a concentric position with the journal housing.

10. The turbomachine of claim 8, wherein the inner journal housing further comprises an inner journal housing shoulder that extends radially-inward from an inner radial surface of the inner journal housing, the inner journal housing shoulder being adapted to maintain the journal bearing in a concentric position with the journal housing.

11. The turbomachine of claim 8, wherein the outer journal housing further comprises an outer journal housing shoulder that extends radially-outward from the outer radial surface of the outer journal housing.

12. The turbomachine of claim 11, wherein the outer journal housing shoulder is adapted to receive one or more first mechanical fasteners that prevent the journal housing from threadably disengaging with the casing.

13. The turbomachine of claim 12, further comprising a thrust housing arranged proximate an axial end of the journal housing and coupled to the casing with one or more second mechanical fasteners, wherein the one or more second mechanical fasteners are positioned at substantially the same radial distance from the shaft as the one or more first mechanical fasteners.

14. A method of operating a turbomachine, comprising, supporting a shaft with a journal bearing, the shaft being arranged for rotation within a casing; and supporting the journal bearing within a journal housing disposed radially-outward from the journal bearing, the journal housing having a series of housing threads defined on an outer radial surface thereof, and the series of housing threads being threadably engageable with a series of casing threads defined on an inner radial surface of the casing, the journal housing further comprising:

an inner journal housing comprising a first inner journal housing section and a second inner journal housing section, the first and second journal housing sections being configured to form a complete annulus when coupled together, and the first inner journal housing section including a shoulder proximate an interface between the first and second inner journal housing sections; and an outer journal housing disposed radially-outward from and concentric with the inner journal housing, wherein the outer journal housing defines the series of housing threads.

15. The method of claim 14, further comprising preventing the journal housing from threadably disengaging from the casing with one or more mechanical fasteners.

16. The method of claim 14, further comprising:

sealing the shaft with a seal arranged inboard from the journal housing; and positioning a spacer ring between the journal housing and the seal, the spacer ring being adapted to maintain a predetermined distance between the journal housing and the seal.

* * * * *